United States Patent [19]

Vöhringer

[11] Patent Number: 4,945,952

[45] Date of Patent: Aug. 7, 1990

[54] MULTIPLE LAYER PAPER MAKING WIRE WITH ZIG ZAG DIRECTED CONNECTING THREADS BETWEEN LAYERS

[75] Inventor: Fritz Vöhringer, Heidenheim, Fed. Rep. of Germany

[73] Assignee: F. Oberdorfer GmbH & Co. KG Industriegewebe-Technik, Fed. Rep. of Germany

[21] Appl. No.: 154,807

[22] Filed: Feb. 11, 1988

[30] Foreign Application Priority Data

Feb. 19, 1987 [DE] Fed. Rep. of Germany ..... 3705345

[51] Int. Cl.[5] ..... D03D 11/00; D03D 13/00; D03D 15/02

[52] U.S. Cl. ..... 139/383 A; 139/410; 139/425 A

[58] Field of Search ..... 139/383 A, 383 R, 410, 139/413, 425 A; 428/224, 225, 257, 223; 162/348, DIG. 1

[56] References Cited

U.S. PATENT DOCUMENTS

| | | | |
|---|---|---|---|
| 4,359,069 | 11/1982 | Hahn | 139/383 A X |
| 4,640,741 | 2/1987 | Tsuneo | 139/383 A |
| 4,709,732 | 12/1987 | Kinnunen | 139/383 A |
| 4,729,412 | 3/1988 | Bugge | 139/383 A |
| 4,739,803 | 4/1988 | Borel | 139/383 A |
| 4,759,391 | 7/1988 | Waldvogel et al. | 139/383 A |

*Primary Examiner*—Andrew M. Falik

*Attorney, Agent, or Firm*—Gifford, Groh, Sprinkle, Patmore and Anderson

[57] ABSTRACT

A composite paper making wire (a generic term for a paper making fabric) as a sheet forming part of a paper-making machine includes an upper fabric layer and a lower fabric layer which are interconnected by longitudinally directed or cross directed connecting yarns of synthetic material. By utilizing the cross directed connecting threads the different cross contractions of that wire are restricted, but not the relative movements between the upper fabric layer and the lower fabric layer in the running direction of the machine as caused by the pertinent load changes on passing the rolling system of the wet part of the paper making machine. These movements destroy the binding threads by wear. Therefore, it is desirable that the composite wire be constructed to be suited for taking over existing tensions in longitudinal and cross-ways directions created by the roller in the paper making machine. To solve this problem at least some of the connecting points or points of interweaving of at least one of the connecting threads of the upper fabric are arranged with respect to the points of interweaving of the lower fabric such that the connecting threads with the upper and lower layers create a zig-zag pattern in the plane view, wherein the connecting threads traverse horizontally creating an oblique angle between the connecting threads and the upper and fabric layers.

11 Claims, 6 Drawing Sheets

MULTIPLE LAYER PAPER MAKING WIRE WITH ZIG ZAG DIRECTED CONNECTING THREADS BETWEEN LAYERS

Background of the Invention

The invention relates to a composite paper making wire as sheet forming part of a paper making machine being composed (a generic term for a paper making fabric) of plastic or composite fabric comprising at least two complete fabrics which are connected by interweaving by means of longitudinally directed or in cross direction extending binding threads.

Until now, prior known paper making wires in the form of composite fabrics are provided with a very fine upper or forming fabric. The fineness and flatness of such a forming fabric defines the quality of the paper. The lower fabric or wear fabric defines the stability and the life time of the composite wire and it is therefore manufactured of thick threads and is not fine but porously structured The paper making wire runs with high speed through the rolling system of the wet part of the paper making machine, dewaters the pulp and transports it to the press part of the machine. During that procedure the tension of the wire very rapidly increases, the wire elongates simultaneously becoming narrower. Immediately after the passage of the driving roll the tension of the wire suddenly decreases and the wire gets broader. Because of the different fineness and the generally non-existent same type of binding of the upper fabric and the lower fabric the mechanical or physical behavior and therefore the contractual properties of the upper and lower fabric are also different. This is the reason for the cross directed shift tension between the upper fabric and the lower fabric which must be taken over by the binding or connecting threads.

The German published application DE-PS 2,917,694 proposes to connect the fabrics by cross directed binding threads. Thus, the different cross contractions of the upper fabric and lower fabric can be measured. On passing through the rolling system of the wet part of the machine the composite fabric alternatively passes over outside and inside located rolls. In connection therewith permanent load changes occur causing a relative movement between the upper fabric and the lower fabric oscillating in machine direction which is the reason why the binding threads are quickly destroyed by wear. This very negative effect cannot be avoided in the known wires by cross directed binding threads, but only by a longitudinal)y directed binding thread system which is, however, not well suited to receive cross directed shift tensions.

Therefore, it is proposed by German patent No. 3,305,713 to use for the connection or joint between two fabrics binding threads extending in longitudinal and cross direction. In such a complicated and obscure structure, however, the request for a surface of the upper fabric as flat as possible and free of connecting point depressions can no longer be fulfilled. A satisfactory quality of weaving seam can no longer be reached with reasonable cost. Both, however, are essential preconditions for the applicability of the composite wire for a paper making machine.

Summary of the Invention

An object of the invention therefore resides in the manufacture of a composite-type fabric or composite fabric that overcomes known problems conventionally associated therewith.

According to another object of the invention the composite fabric should be suited for controlling cross and longitudinal shift tensions by nearly equating the elongation on the longitudinally directed binding thread parts with the shrinkage of the cross directed binding parts. These opposing forces avoid negative effects on the paper side surface by forming binding point depressions or joint point depressions, and further essentially diminish relative movements between the upper fabric and the lower fabric of the composite wire.

These and other objects are accomplished by the inventive idea to interlace the joint or binding threads in such a way that the upper binding points are in the direction of the relative movement distantly spaced from the lower ones so, that in that direction a tension component will be created which obviates the relative movement.

The zig-zag-like run of the binding threads extending only in one direction can reduce longitudinally directed as well as cross directed relative movements between the fabrics in accordance with the invention in an extent which can be tolerated. Thus, along the connecting thread direction laterally directed holding points are formed. It goes without saying that the number of the left and right oriented holding points must be the same. Thus, a secure connection or joint between the upper fabric and the lower fabric is established which is similar to the tensioning of an erected tent. As such a tensioning avoids that the tent rods tilt, the binding thread guidance in accordance with the invention minimizes detrimental relative movements between the upper fabric and the lower fabric.

The binding threads can extend in running direction, i.e. in machine direction or cross to the running direction of the paper making machine. Wires are called flat woven wires, if the direction of weaving correspond to the running direction. Wires which are weft in this manner must be heavily stretched under the influence of heat in order to gain a sufficient stability in longitudinally direction. By doing that the longitudinally directed binding threads are likewise stretched. The increase of tension within the binding threads which is caused by the above stretching is together with the heat influence the reason for permanent depressions within the sensitive upper fabric, which depressions form in the paper markings. That is the reason why until now all composite wires as used on paper making machines are provided with cross directed binding threads.

According to the invention it is now possible to manufacture also flat woven composite wires having longitudinal directed connecting or joint threads. The above mentioned stretching, of course, establishes not only a permanent elongation but also in cross direction a permanent shrinkage of the same quantity. As the binding threads of the composite wire or fabric according to the invention have not only longitudinally directed but also cross directed portions of similar quantity, the increase of tension in the longitudinally directed binding threads during the stretching process is avoided. The elongation of the longitudinally directed connecting thread portions is nearly equalized by the shrinkage of the cross directed binding thread portions.

Description of the drawings

A better understanding of the invention will be reached by reference to the following detailed description when read in conjunction with the accompanying drawings in which.

DETAILED DESCRIPTION OF THE PREFERRED EMBODIMENTS OF THE INVENTION

Figure 1:
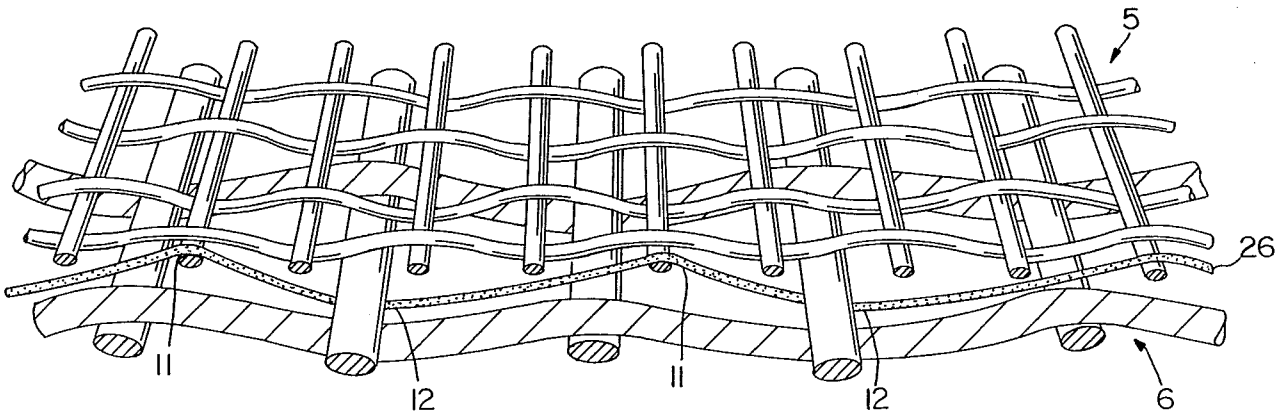
FIG. 1 PRIOR ART
FIG. 1 is a perspective view of known prior art showing the upper side (left) and the lower side of a known composite wire provided with cross directed connecting threads.

The upper fabrics and lower fabrics are illustrated in the drawings in form of weave patterns showing the structure of the outer sides of the wires.

According to the present invention, at least one of the connecting threads is a monofilament yarn having an elasticity of at least thirty percent in longitudinal direction. The diameter of the connecting threads is equal to or less than three-fourths of the thickest thread of the upper fabric layer.

The composite wire as shown in FIG. 1 and known in the art comprises a fine upper fabric 5 in a simple binding and a coarse lower fabric 6 in cross-Batavia-binding. The binding points 11 within the upper fabric and 12 within the lower fabric 6 are located in the projection onto a plane parallel to the wire surface on a straight line. By that connecting or joint system movements between the single fabrics cross to the direction of extension of the binding threads cannot be avoided as shown by the invention.

Reference numeral 26 refers to a conventional binding thread.

Figure 2:
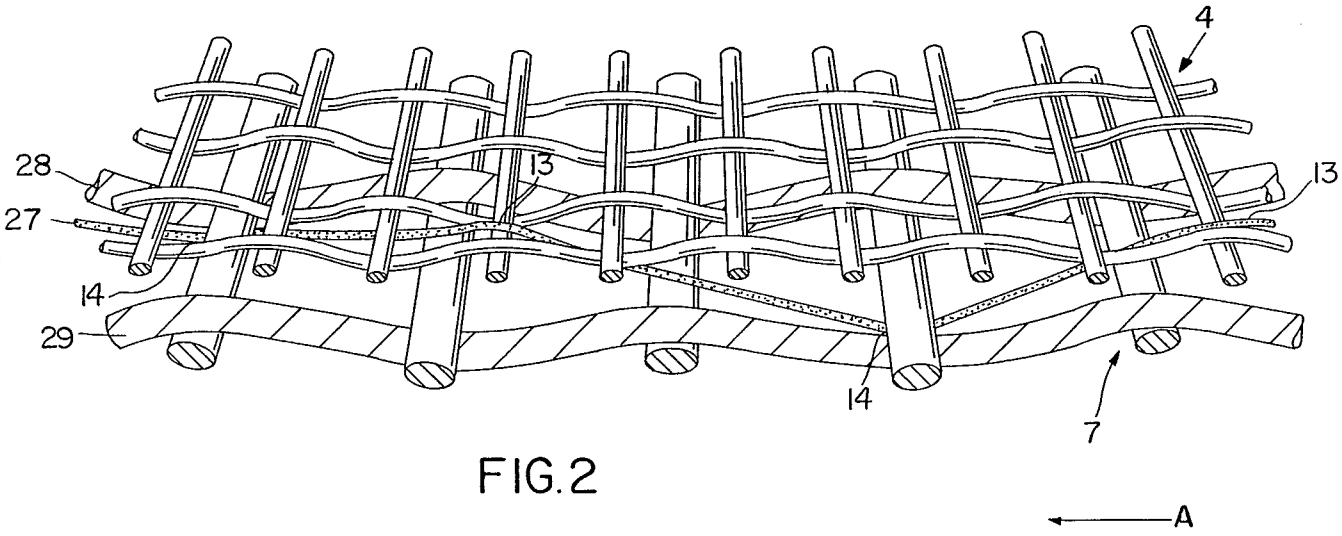
FIG. 2 is a perspective view of the upper side (above) and the lower side of a composite wire in accordance with the invention provided with cross directed binding threads.
Figure 3:
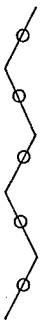
FIG. 3 is a projection of a binding thread according to the invention onto a plane, parallel to the wire surface, wherein the binding points within the upper fabric are marked with points and are located within the lower fabric on the corners of the zig-zag-line directed to the left and to the right.
Figure 6:
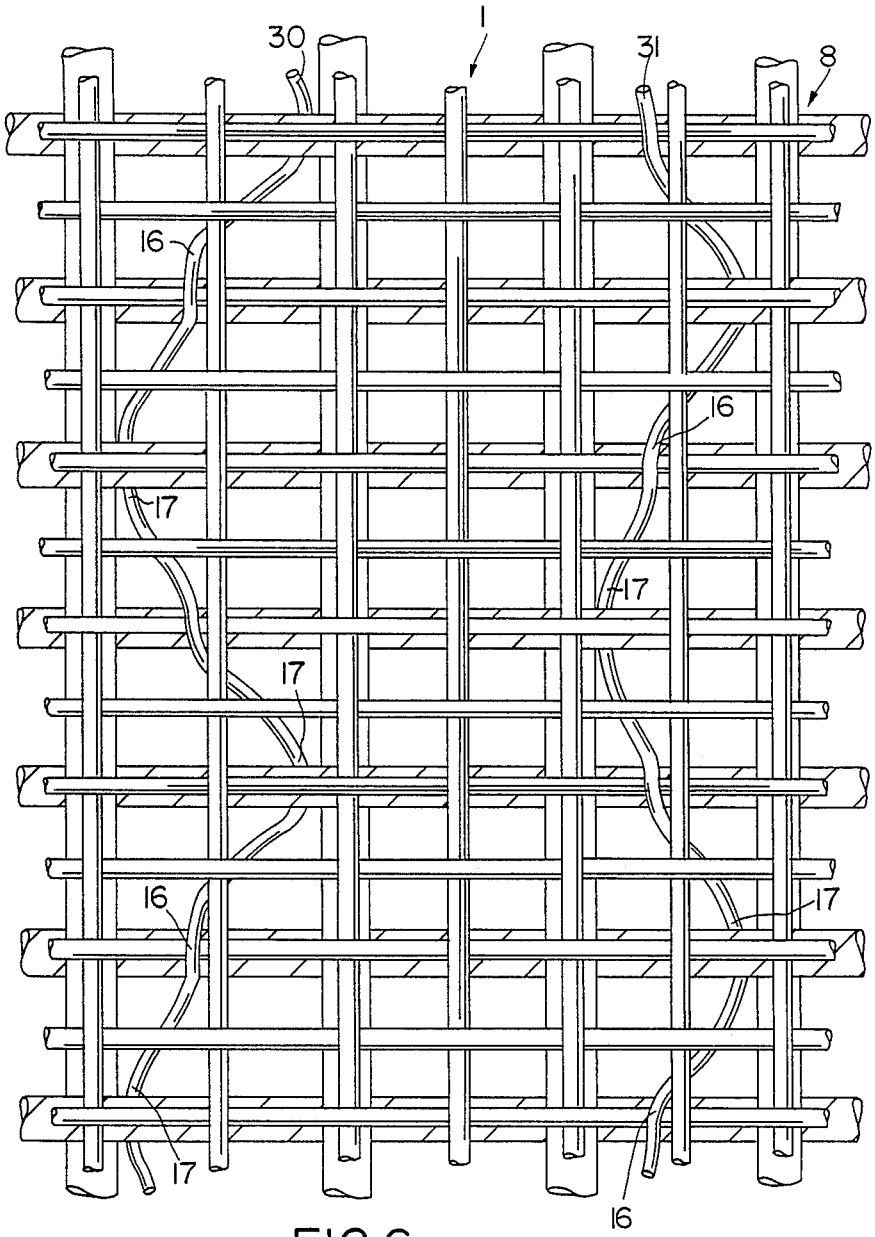
FIG. 6, 7 and 8 are plan views of the upper sides and lower sides of composite wires in accordance with the invention provided with longitudinally directed connecting- or joint-threads and having different types of binding within the upper fabric and the lower fabric.

FIG. 2 shows the composite wire according to the invention provided with a lower fabric 7 having a binding wherein only the connecting points or joint points 13 of the upper fabric 4 are located on a straight line. The upper fabric 4 has a two-shed binding. The connecting points 14 of the lower fabric 7 are in contrast thereto in the direction of extension of the connecting threads alternatively displaced to the left and right. The connecting points 13 are approximately located in the center between the connecting points 14 at the left and at the right. Reference numeral 27 refers to a binding thread according to the present invention, whereas numerals 28, 29 refer to adjacent cross threads of the lower layer or web. The connecting point 14 of the connecting thread 27 is positioned at cross thread 28. The next connecting point 14 within the lower web 7 is located at cross thread 29. The projection of the binding thread as shown in FIG. 2 onto a plane parallel to the surface of the wire corresponds to the zig-zag-line shown in FIG. 3, seen in binding thread direction designated in FIG. 2 by the arrow A. FIG. 6 is a view similar to that of FIG. 3 showing the transverse path of connecting threads 30 and 31.

The points of interweaving the connecting thread with the upper and lower layers create a zig-zag pattern in the plane view, wherein the connecting thread transverses horizontally creating an oblique angle between the connecting thread and the upper and lower fabric layers.

Of course, it is also possible, as shown by FIG. 6, to use a lower fabric 8 comprising a cross-Koeper-binding. The binding points 16 are located in longitudinal direction in the upper fabric 1. The associated binding points 17 in the lower fabric again form alternatively located holding points at the left and at the right of that line. The projection of the binding thread corresponds to the illustration of FIG. 3.

Figure 7:
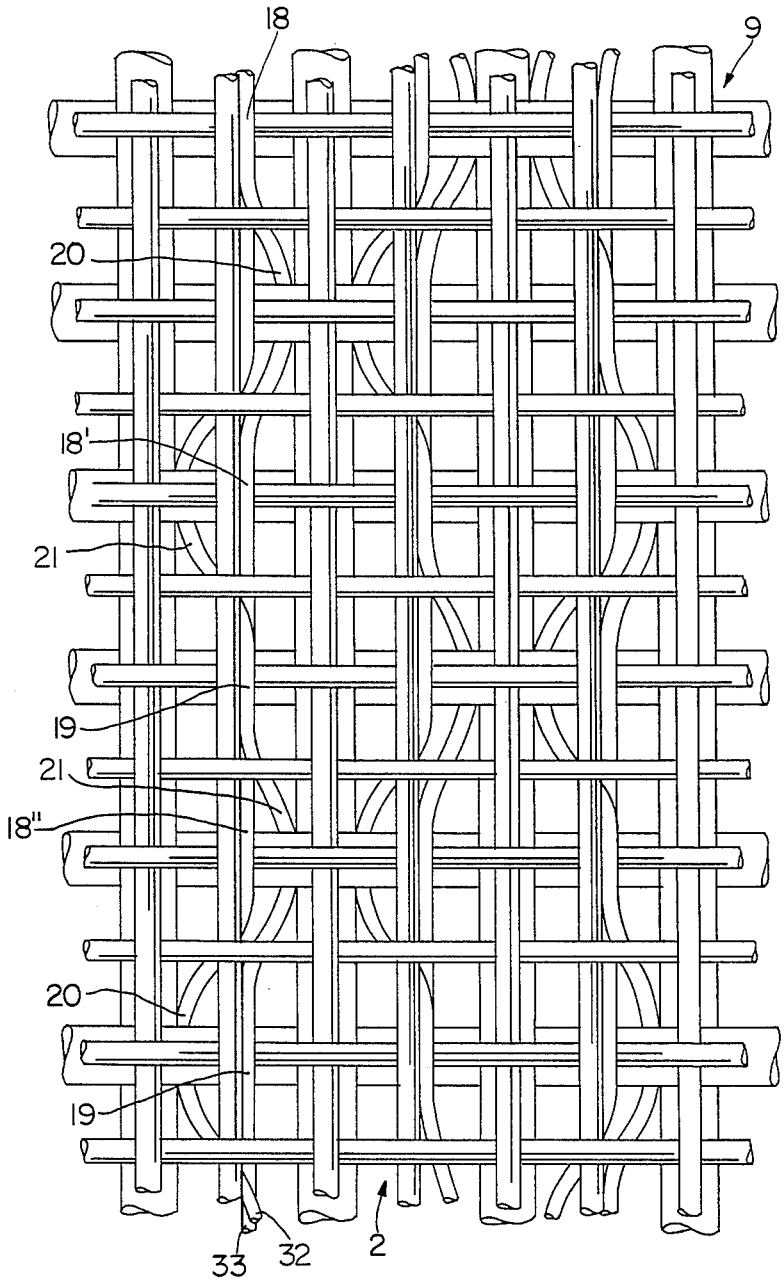

An especially favorable embodiment of the invention is shown in FIG. 7, wherein a lower fabric 9 provided with a three-Koeper-binding is used. In this embodiment two longitudinal directed binding threads 32, 33 are respectively joined along one longitudinal thread of the upper fabric 2. Binding points 18, 19 of the pair of binding threads are again located on one line, whereas the associated binding points 20, 21 within the lower fabric are alternatively located at the right and at the left of that line. Attention is drawn to the fact that the binding threads between the binding points 18′ and 18″ span a straight line and are not interlaced between those points with the lower fabric 9, because at that location of lower fabric no suitable binding point place exists.

Figure 4:
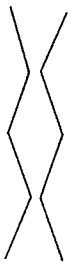
FIG. 4 is a projection of two subsequent binding threads according to the invention wherein the binding points within the upper fabric are located on the outwardly directed corners and within the lower fabric on the inwardly directed corners.
Figure 8:
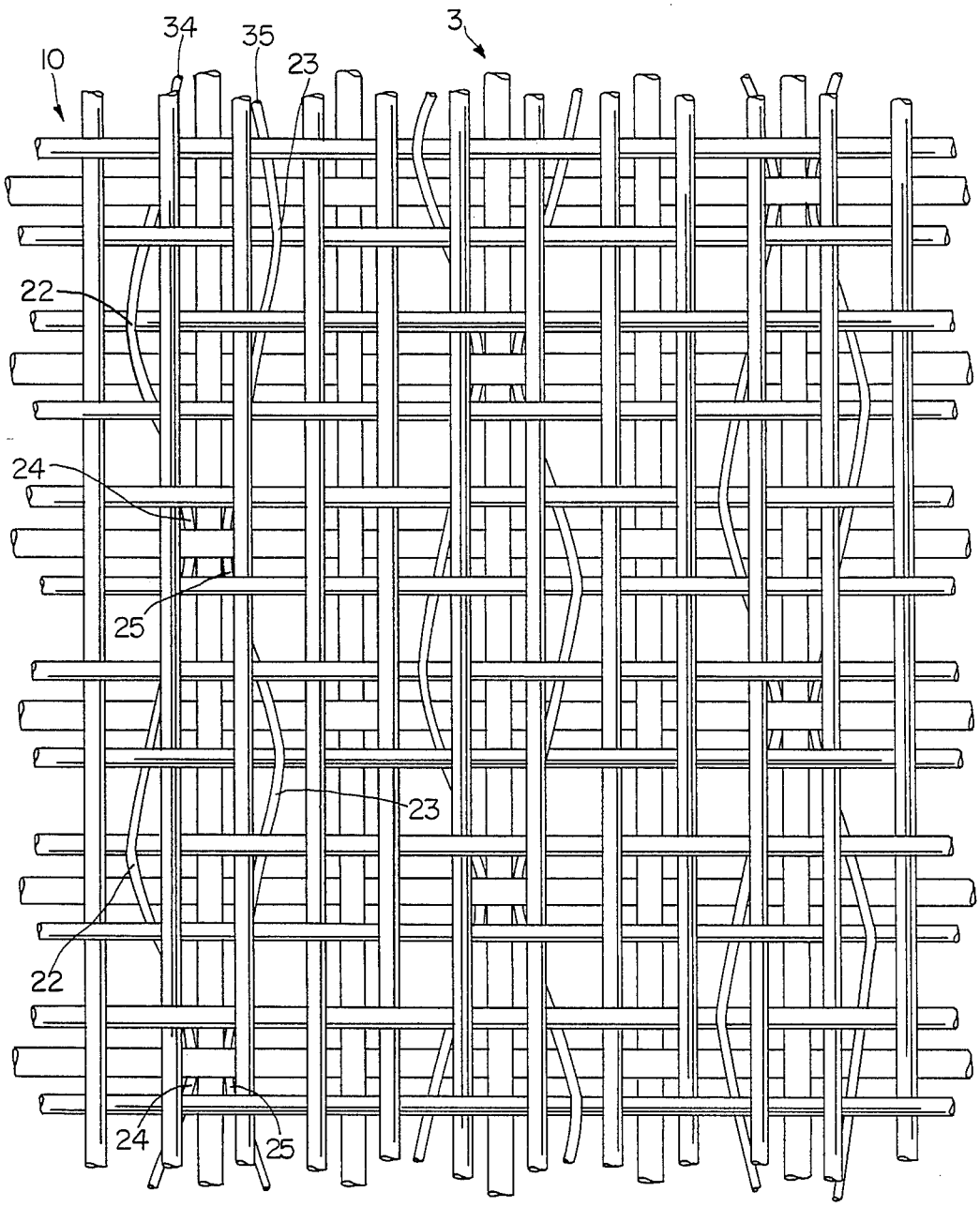

FIG. 8 shows a composite wire consisting of two differently fine three-Koeper-fabrics. The outer side of the upper fabric 10 is provided with longitudinal floats. The outer side of the lower fabric 3 is provided with cross floats. This composite wire is therefore a weft runner as shown by the wires in FIGS. 6 and 7. The binding points 24 of the lower fabric belonging to the binding points 22 are all located with respect to the binding points 22 at the right, whereas the binding points 25 of the lower web 3 belonging to the binding points 23 of the next binding thread are all located at the left. The projection of both of these successive binding threads therefore corresponds to the illustration of FIG. 4. Reference numerals 30, 31 in FIG. 6 mean binding threads according to the invention running in the longitudinal direction of the wire and having a zig-zag configuration as shown in Serial No. 154,807 - Page 3 FIG. 3. Reference numerals 34, 35 are directed to binding threads according to the invention running as shown in FIG. 4.

Figure 5:
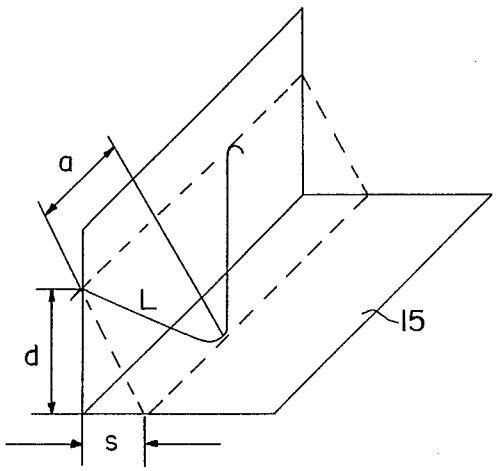
FIG. 5 is a perspective view showing the three-dimensional course of a binding thread according to the invention between three subsequent binding points, wherein the surface 15 extends parallel to the sheet forming plane or wire plane.

As stated hereinbefore, flat woven wires must be strongly stretched during heating them in order to gain a satisfactory stability in longitudinal direction. In doing that longitudinally directed connecting threads are stretched which causes in the binding threads an increase of tension which results in troublesome depressions within the sensitive upper fabric. These depressions cause markings in the paper which are to be avoided. On the basis of FIG. 5 the following relationship may be established wherein the numeral 15 designates the surface extending parallel to the plane of the flat wire:

$$l=\sqrt{d^2+S^2+a^2}\ S>0$$

The meaning of the above letters is the following:

l≅partial length of the connecting thread, i.e. the length of the connecting thread between one binding point in the upper fabric and that binding point in the lower fabric following said binding thread in longitudinal direction;

d≅the thickness of the wire measured from the upper side of the upper fabric to the lower side of the lower fabric;

s≅the distance by which two binding points following one another in longitudinal direction of the binding thread are laterally displaced in the lower fabric with respect to the upper fabric;

a≅the distance between two binding points following one another in longitudinal direction of the binding thread.

During the stretching "a" increases corresponding to the stretch in that direction. However, the value of "s" decreases by the cross shrinkage. The thickness of the wire is also increasing and thus the value of "d".

The partial length 1 of the binding thread can be maintained constant if the starting values $d_A$, $s_A$ and $a_A$ are chosen favorably.

$$l_A=\sqrt{d^2_A+S^2_A+a^2_A}=l_E\sqrt{d^2_E+S^2_E+a^2_E}$$

The meaning of the used letters is the following:

$l_A$=partial length of the binding thread prior to the stretching process $l_E$=partial length of the binding thread after the stretching process If a stretching of the binding threads does not occur, the unfavorable depressions do not result. The condition $l_A=l_E$ can be substantially attained if the starting value of the smallest possible binding point distance a is chosen.

FIGS. 6 and 7 are examples for such a procedure. If wanted the distance a may be chosen, however, still smaller than in both of these examples.

In the fabric or wire as shown in FIG. 8 the distance of the binding points need not to be shorter because the binding points of the upper fabric 10 are all located on cross knuckles directed inwardly, and do therefore not essentially affect the surface. Thus, it is satisfactory, to use binding threads of high elongation consisting of polyester or polyamid. In dependency from the high elongation such threads have only a small shrinkage on heating them and develop correspondingly less shrinkage tensions.

Having described our invention, however, many modifications thereto will become apparent to those skilled in the art to which it pertains without deviation from the spirit of the invention as defined by the following claims.

The term "thread" or "threads" as used herein before should mean "yarn" or "yarns" respectively. Moreover, as pointed out in the abstract of disclosure, it is stressed that the term "wire" does not mean forming fabrics for paper making machines consisting of woven wire structures made of materials such as phosphor-bronze, stainless steel, brass or combinations thereof, but should mean a woven wire structure of synthetic materials of any known type, for instance of polyesters such as Dacron or Trevira, akrylic fibers such as Orlon, Dynel and Acrilan, copolymers such as Saran or polyamids such as Nylon. The warp and weft threads or yarns of the forming fabric may be of the same or different material and may be in the form of monofilament or multifilament yarn.

Moreover, the hereinbefore used term "connecting point" should be understood as "joint point" and the term "cross direction" should have the meaning of "cross machine direction", whereas the term "longitudinal direction" should have the meaning of "longitudinal machine direction".

We claim:

1. A composite paper-making wire as sheet forming part of a paper-making machine sheet comprising:

an upper fabric layer, and a lower fabric layer, wherein said upper fabric layer is connected to said lower fabric layer by at least two connecting thread, said connecting thread interwoven between said upper and lower layers in both a longitudinal and crossways direction;

said connecting thread crating an upper connecting point with said upper fabric layer and a lower connecting point with said lower fabric layer;

wherein the points of interweaving of said connecting thread with said upper and lower layers create a zig-zag pattern in the plane view, wherein said connecting thread traverses horizontally creating an oblique angle between said connecting thread and said upper or lower fabric layer;

wherein said connecting thread runs substantially perpendicular to said upper and lower fabric layers forming a straight line pattern in the perspective view;

wherein said connecting thread further comprises a connecting thread length equal to the length between said one point of interweaving of said lower fabric layer and said one point of interweaving of said upper fabric layer, said connecting thread length defined as $$l=\sqrt{d^2+s^2+a^2}\ s>0$$

where l is the connecting thread length;

d is the vertical distance of the connecting thread measured from an upper side of said upper fabric layer to a lower side of said lower fabric layer;

s is the horizontal distance between said upper connecting point and said lower connecting point; and a is the transverse distance between said upper connecting point and said lower connecting point.

2. A composite paper making wire according to claim 14 characterized in that said at least one connecting thread runs in a longitudinal direction corresponding to the longitudinal direction of said paper-making machine.

3. A composite paper making wire according to claim 1, characterized in that the upper fabric comprises a two-shed binding.

4. A composite paper making wire according to claim 1, characterized in that the upper fabric comprises a Koeper-binding.

5. A composite paper making wire according to claim 1, characterized in that the lower fabric layer comprises a two-shed binding.

6. A composite paper making wire according to claim 1, characterized in that the lower fabric comprises a Koeper-binding.

7. A composite paper making wire according to claim 6, characterized in that said composite wire consists of two three-Koeper-fabrics of different quality fineness and that the outer side of the upper fabric comprises longitudinal floats and the outer side of the lower fabric comprises cross floats.

8. A composite paper making wire according to claim 1, characterized in that said connecting thread consists of multifilament yarns.

9. A composite paper making wire according to claim 1, characterized in that said at least one connecting thread is a monofilament yarn having an elasticity of at least 30% in the longitudinal direction.

10. A composite paper making wire according to claim 9, characterized in that the diameter of said at least one connecting thread is equal to or less than $\frac{3}{4}$ of the thickest thread of said upper fabric layer.

11. A composite paper making wire according to claim 1, characterized in that the number of said connecting points within said lower fabric layer is at least equal to the number of threads extending crossway to said longitudinal direction of said paper-making machine lower fabric layer.

* * * * *